US011653133B2

(12) United States Patent
Ko et al.

(10) Patent No.: US 11,653,133 B2
(45) Date of Patent: May 16, 2023

(54) SPEAKER UNIT FOR EARPHONE

(71) Applicant: ALMUS Corp., Chungcheongnam-do (KR)

(72) Inventors: Ju Heon Ko, Gyeonggi-do (KR); Byung Il Min, Gyeonggi-do (KR); Jeong Kwon Park, Gyeonggi-do (KR); Yun Uk Ha, Incheon (KR); JongWon Lee, Incheon (KR); Seo Young Kim, Gyeonggi-do (KR); Soon Hyuk Hong, Gyeonggi-do (KR)

(73) Assignee: ALMUS Corp., Chungcheongnam-do (KR)

( * ) Notice: Subject to any disclaimer, the term of this patent is extended or adjusted under 35 U.S.C. 154(b) by 0 days.

(21) Appl. No.: 17/325,318

(22) Filed: May 20, 2021

(65) Prior Publication Data

US 2022/0312097 A1 Sep. 29, 2022

(30) Foreign Application Priority Data

Mar. 26, 2021 (KR) ..... 10-2021-0039900

(51) Int. Cl.
*H04R 1/10* (2006.01)

(52) U.S. Cl.
CPC ..... *H04R 1/10* (2013.01)

(58) Field of Classification Search
CPC ..... H04R 1/10; H04R 1/1016; H04R 1/24; H04R 1/403; H04R 1/20; H04R 1/26; H04R 9/025; H04R 9/00; H04R 9/06; H04R 9/063; H04R 9/02; H04R 3/08
USPC ..... 381/412, 380, 186, 401, 402, 421
See application file for complete search history.

(56) References Cited

U.S. PATENT DOCUMENTS

2015/0016660 A1* 1/2015 Matsumura ..... H04R 9/06 381/415
2021/0021920 A1* 1/2021 Choi ..... H04R 1/1016
2021/0377668 A1* 12/2021 Park ..... H04R 1/44
2022/0038810 A1* 2/2022 Ji ..... H04R 9/04

FOREIGN PATENT DOCUMENTS

KR 20150104878 A * 9/2015 ..... H04R 9/02
WO WO-2019053505 A1 * 3/2019 ..... H04R 1/06

* cited by examiner

*Primary Examiner* — Ahmad F. Matar
*Assistant Examiner* — Sabrina Diaz
(74) *Attorney, Agent, or Firm* — Harness, Dickey & Pierce, P.L.C.

(57) ABSTRACT

A speaker unit for an earphone is provided. The speaker unit for an earphone may include a frame; a magnet; a plate fixed to the frame and in contact with the magnet; a diaphragm; a coil disposed to overlap the magnet and the plate in a radial direction; and a flexible printed circuit board (FPCB), wherein the magnet includes a first surface and a second surface arranged on an outer surface of the magnet, the first surface is a surface in contact with an inner surface of the frame, the second surface is a surface spaced apart from the inner surface of the frame, and the frame forms a first sound emission path defined by a space between the inner surface thereof and the second surface of the magnet in the radial direction.

7 Claims, 20 Drawing Sheets

SPEAKER UNIT FOR EARPHONE

CROSS-REFERENCE TO RELATED APPLICATION

This application claims the benefit under 35 USC § 119(a) of Korean Patent Application No. 10-2021-0039900, filed on Mar. 26, 2021, in the Korean Intellectual Property Office, the entire disclosure of which is incorporated herein by reference for all purposes.

FIELD

The following description relates to a speaker unit for an earphone.

BACKGROUND

The earphone includes, inside a housing, a speaker unit that generates sound waves.

The speaker unit may include a diaphragm, a magnet, a coil, and a plate. When electric current is applied to the coil, the coil is magnetized, and the diaphragm moves as the coil moves due to the interaction between the coil and the plate.

Such a speaker unit includes a configuration for reproducing low-frequency sounds and a configuration for reproducing high-frequency sounds (two-way type). In order to emit low-frequency sounds in the direction of emission of high-frequency sounds, a space between a high-frequency diaphragm and the coil is used as a sound emission path.

However, since the space between the high-frequency diaphragm and the coil is quite small, a loss of sound volume occurs. In addition, the sound emission path of the low-frequency sounds is limited to the radial extent of the diaphragm, and thus the intensity of sound and the reproducible sound range are limited. Also, there is a problem in that the magnetic force between the magnet and the plate is lost.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

An objective of the present invention is to provide a speaker unit for an earphone securing the size of a diaphragm, reducing loss of sound volume, increasing the intensity of sound, and extending the reproducible sound range.

The objective to be achieved by the present invention is not limited to the foregoing objective, and additional objectives, which are not mentioned herein, will be readily understood by those skilled in the art from the following description.

According to an embodiment, there is provided a speaker unit for an earphone including a frame, a magnet, a plate fixed to the frame and in contact with the magnet, a diaphragm, a coil disposed to overlap the magnet and the plate in a radial direction, and a flexible printed circuit board (FPCB), wherein the magnet includes a first surface and a second surface arranged on an outer surface of the magnet, the first surface is a surface in contact with an inner surface of the frame, the second surface is a surface spaced apart from the inner surface of the frame, and the frame forms a first sound emission path defined by a space between the inner surface thereof and the second surface of the magnet in the radial direction.

The plate may include a first plate in contact with one side of the magnet and a second plate in contact with the other side of the magnet, the diaphragm may include a first diaphragm disposed in front of the first plate and a second diaphragm disposed at a rear of the second plate, the first plate may include a third surface spaced apart from the magnet in a front-to-rear direction, the first plate and the magnet may form a second emission path connected to the first sound emission path, and the second sound emission path may be defined by a space between the third surface and the magnet.

The first plate may include an inner portion and an outer portion which is disposed outside the inner portion and disposed to be stepped from the inner portion, and a third sound emission path defined by a space between a stepped surface between the inner portion and the outer portion, the FPCB, and the frame may be formed.

The frame may include a groove corresponding to the second surface and separating the second surface and the inner surface of the frame, and a guide portion in contact with the second surface.

The first surface and the second surface may each be a flat surface, and the first surface and the second surface may be disposed to form a right angle or an obtuse angle to each other.

The first surface and the second surface may be alternately disposed along the outer surface of the magnet.

The first surface may be a curved surface, and the second surface may be a flat surface.

A portion of the outer surface of the magnet may be the first surface formed as a single curved surface, and the rest of the outer surface of the magnet may be the second surface formed as a single flat surface.

The speaker unit may further include a first coil fixed to the first diaphragm and a second coil fixed to the second diaphragm, wherein the FPCB may include an extended portion through which a connection end of the first coil and the second coil passes, and the extended portion may include an escape portion spaced apart from the first coil.

The frame may further include a hole penetrating inside and outside of the frame, the speaker unit may further include an air pressure equalization path defined by a space between the frame, the magnet, and the first plate, and the air pressure equalization path may allow the outside of the frame and a front space of the first diaphragm to communicate with each other through the hole.

The FPCB may be attached to the third surface of the first plate.

Other features and aspects will be apparent from the following detailed description, the drawings, and the claims.

Figure 1:
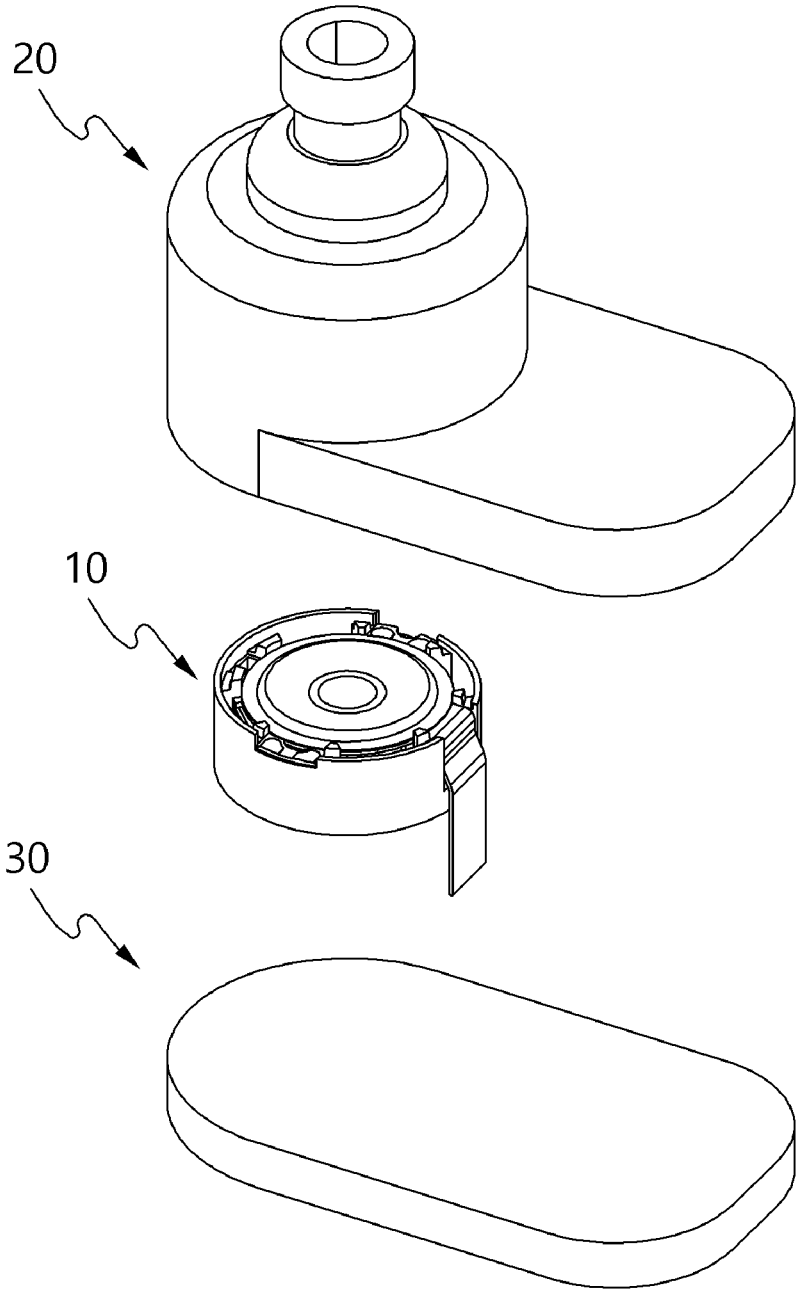
FIG. 1 is an exploded view of an earphone including a speaker unit according to an embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

The objects, features and advantages of the present invention will be more clearly understood from the following detailed description and preferred embodiments taken in conjunction with the accompanying drawings. It should be understood that terms or words used in the specification and the appended claims should not be construed as being limited to commonly employed meanings or dictionary definitions, but interpreted based on meanings and concepts corresponding to the technical idea of the invention, on the basis of the principle that inventors are allowed to define terms appropriately for the best explanation of their invention. Further, in the description of the present invention, detailed descriptions of related well-known functions that are determined to unnecessarily obscure the gist of the present invention will be omitted.

Hereinafter, a speaker unit for an earphone according to an embodiment will be described in detail with reference to the accompanying drawings.

Figure 2:
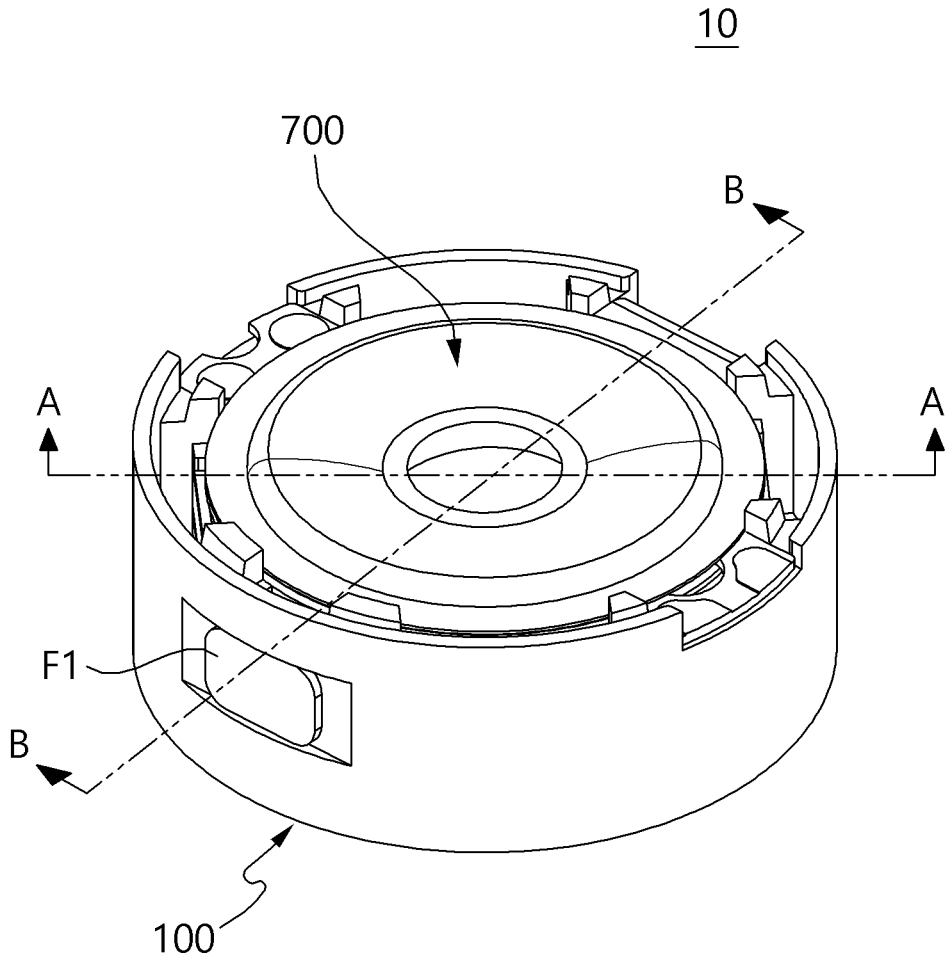
FIG. 2 is a perspective view of the speaker unit shown in FIG. 1.
Figure 3:
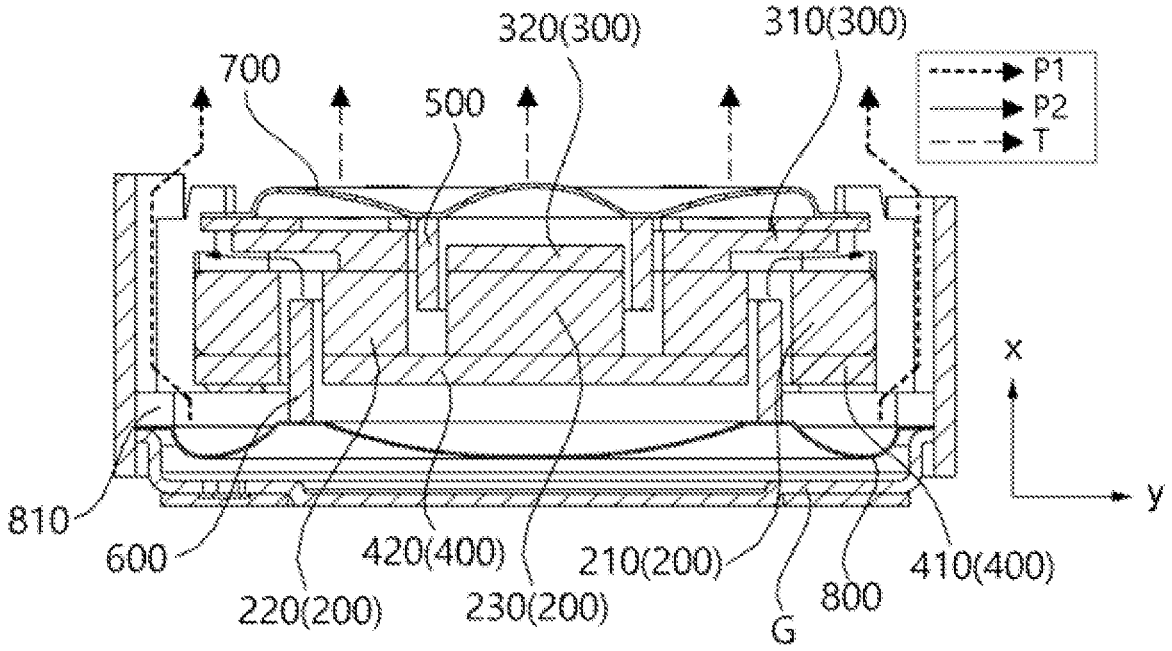
FIG. 3 is a side cross-sectional view of the speaker unit, taken along line A-A of FIG. 1.
Figure 4:
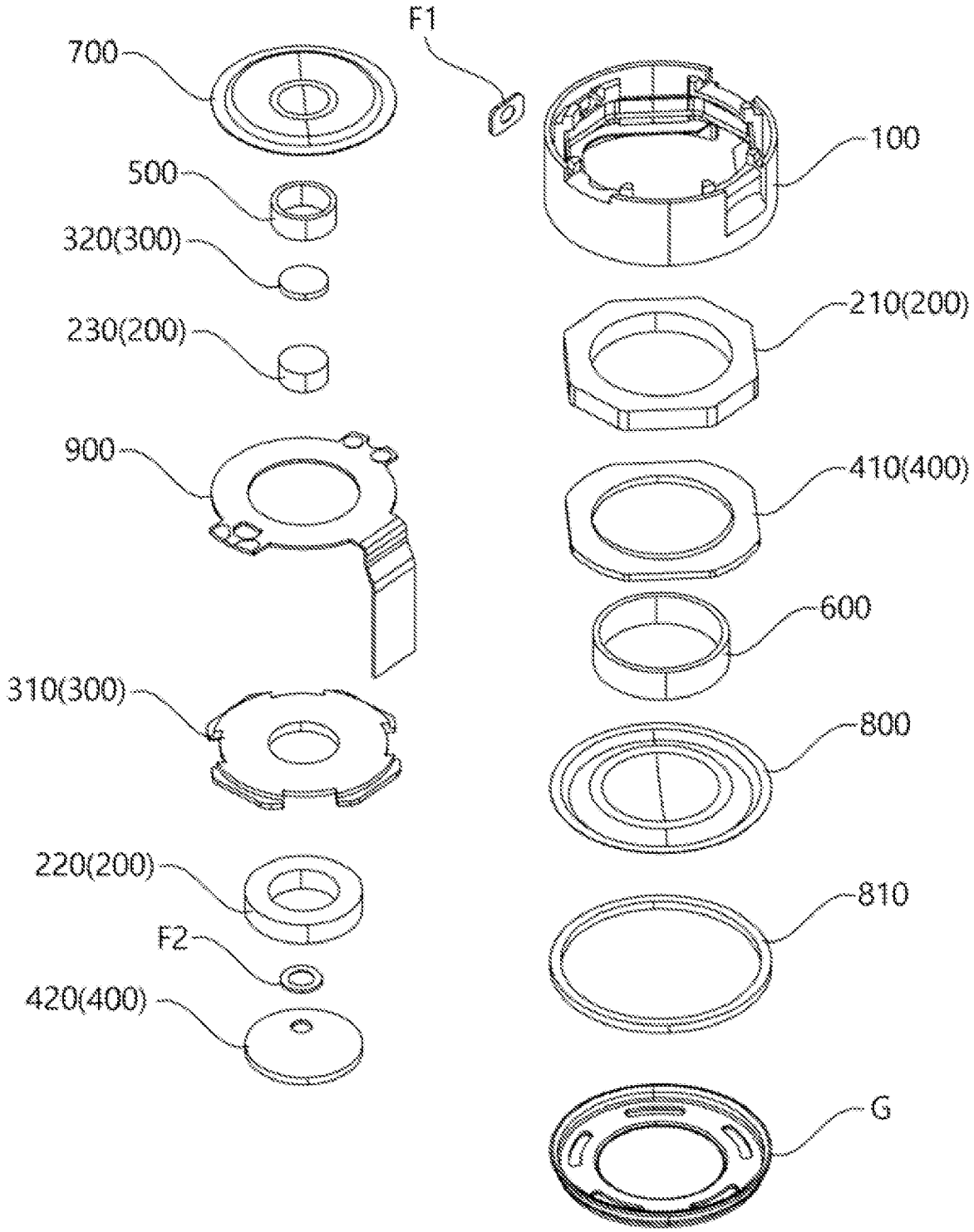
FIG. 4 is an exploded view of the speaker unit shown in FIG. 1.

FIG. 1 is an exploded view of an earphone including a speaker unit according to an embodiment; FIG. 2 is a perspective view of the speaker unit shown in FIG. 1; FIG. 3 is a side cross-sectional view of the speaker unit, taken along line A-A of FIG. 1; and FIG. 4 is an exploded view of the speaker unit shown in FIG. 1.

Hereinafter, in the drawings, the x-axis represents the front-to-rear direction of an earphone, and the y-axis represents the radial direction of the earphone. The terms "front" or "forward" refer to a direction in which a sound is emitted through a first diaphragm 700 and a second diaphragm 800, and the terms "rear" or "rearward" refer to the direction opposite to the front or forward direction.

A speaker unit 10 according to an embodiment includes both a configuration for reproducing low-frequency sounds and a configuration for reproducing high-frequency sounds (two-way type). In addition, the speaker unit 10 according to the embodiment includes a configuration for reproducing low-frequency sounds and a configuration for reproducing high-frequency sounds.

The speaker unit 10 according to the embodiment may be disposed in an inner space formed by a housing 20 and a cover 30.

The speaker unit 10 according to the embodiment includes a frame 100, a magnet 200, a first plate 300, a second plate 400, a first coil 500, a second coil 600, a first diaphragm 700, a second diaphragm 800, and a flexible printed circuit board (FPCB) 900. The speaker unit 10 according to the embodiment may secure a sound emission path between the frame 100 and the magnet 200 by changing the shape of the magnet 200.

The frame 100 may be a cylindrical member.

The magnet 200 electromagnetically interacts with the first coil 500 and the second coil 600. The magnet 200 may include a first magnet 210, a second magnet 220, and a third magnet 230. The first magnet 210 may be disposed outside the second coil 600 and fixed to the frame 100. The third magnet 230 may be disposed inside the first coil 500. The second magnet 220 may be disposed between the first coil 500 and the second coil 600 in the radial direction y.

With respect to the radial direction y of the earphone, the third magnet 230 may be positioned innermost, the first magnet 210 may be positioned outermost, and the second magnet 220 may be disposed between the first magnet 210 and the third magnet 230.

The first magnet 210 and the second magnet 220 may be annular members. The third magnet 230 may be a cylindrical member.

The first magnet 210 and the second magnet 220 are used for reproducing low-frequency sounds, and the second magnet 220 and the third magnet 230 are used for reproducing high-frequency sounds.

The first plate 300 that is in contact with one surface of the magnet 200 creates a magnetic field. The first plate 300 may include a first A plate 310 and a first B plate 320. The first A plate 310 may have a ring shape. The first A plate 310 is in contact with one surface of the first magnet 210 and one surface of the second magnet 220. The first B plate 320 may have a disk shape. The first B plate 320 is in contact with one surface of the second magnet 220.

The second plate 400 in contact with the other surface of the magnet 200 creates a magnetic field. The second plate 400 may include a second A plate 410 and a second B plate 420. The second A plate 410 may be an annular plate. The second A plate 410 is in contact with the other surface of the first magnet 210. The second B plate 420 may have a disk shape. The second B plate 420 is in contact with one surface of the second magnet 220 and one surface of the third magnet 230.

The first coil 500 is fixed to the first diaphragm 700. When the first coil 500 moves, the first diaphragm 700 also moves in conjunction with this movement. The first coil 500 may be disposed between the second magnet 220 and the third magnet 230 in the radial direction y. Also, the first coil 500 may be disposed between the first A plate 310 and the first B plate 320 in the radial direction y. Accordingly, the first coil 500 is disposed to partly overlap the second magnet 220 and the third magnet 230 in the radial direction y. In addition, the first coil 500 is disposed to partly overlap the first plate 300 in the radial direction y. The first coil 500 may be used for reproducing high-frequency sounds.

The second coil 600 is fixed to the second diaphragm 800. When the second coil 600 moves, the second diaphragm 800 also moves in conjunction with this movement. The second coil 600 may be disposed between the first magnet 210 and the second magnet 220 in the radial direction y. Also, the second coil 600 may be disposed between the second A plate 410 and the second B plate 420 in the radial direction y. Accordingly, the second coil 600 is disposed to partly overlap the first magnet 210 and the second magnet 220 in the radial direction y. In addition, the second coil 600 is disposed to partly overlap the second plate 400 in the radial direction y. The first coil 500 may be used for reproducing high-frequency sounds.

The first diaphragm 700 may be fixed to the FPCB 900. The first diaphragm 700 may be used for reproducing high-frequency sounds.

The second diaphragm 800 may be fixed to a fixing ring 810. The fixing ring 810 may be fixed to a grill G and the frame 100. The second diaphragm 800 may be used for reproducing low-frequency sounds.

The FPCB 900 supplies an electrical signal to the first coil 500 and the second coil 600. The FPCB 900 may be made of a soft material.

A first tuning portion F1 may be disposed on the frame 100. A second tuning portion F2 may be disposed on the first B plate 320. The first tuning portion F1 and the second tuning portion F2 may be for changing the tone or acoustic characteristics, and may be of a mesh material, including polyester, nylon, a non-woven fabric, a membrane filter, and the like.

A magnetic field moves to a space between the first plate 300 and the second plate 400. When the first coil 500 and the second coil 600 are magnetized by an electric current applied thereto, the first coil 500 and the second coil 600 move according to magnetic polarities thereof.

That is, when the magnetic polarity of the first coil 500 is the same as that of the first plate 300, the first coil 500 is repelled and moves away. When the magnetic polarity of the second coil 600 is the same as that of the second plate 400, the second coil 600 is repelled and moves away. On the other hand, when the magnetic polarity of the first coil 500 is opposite to that of the first plate 300, the first coil 500 is attracted and moves toward the first plate 300. In addition, when the magnetic polarity of the second coil 600 is opposite to that of the second plate 400, the second coil 600 is attracted and moves toward the second plate 400. In this way, the first diaphragm 700 and the second diaphragm 800 move, causing air to vibrate and produce a sound.

The first diaphragm 700 emits a sound in the front direction as depicted by T in FIG. 3. The second diaphragm 800 may emit a sound through a first sound emission path as depicted by P1 in FIG. 3. Also, the second diaphragm 800 may emit a sound through a second sound emission path as depicted by P2 in FIG. 3. The speaker unit 10 according to the embodiment may reduce loss of the volume of the low-frequency sound by emitting the low-frequency sound in the front direction through the first sound emission path, as well as through the second sound emission path.

Figure 5:
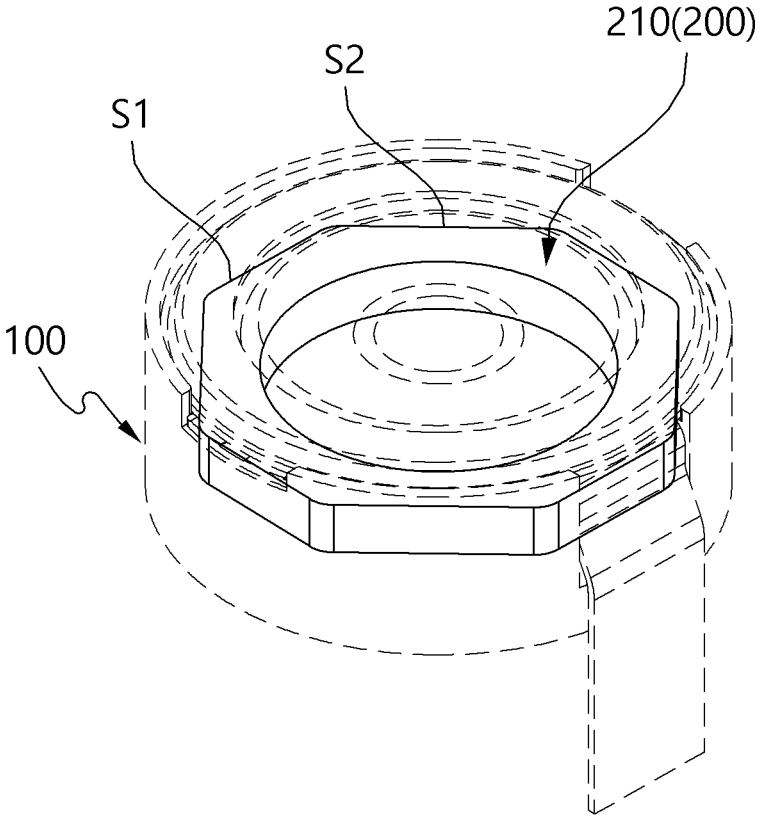
FIG. 5 is a view of a speaker unit including a first magnet.
Figure 6:
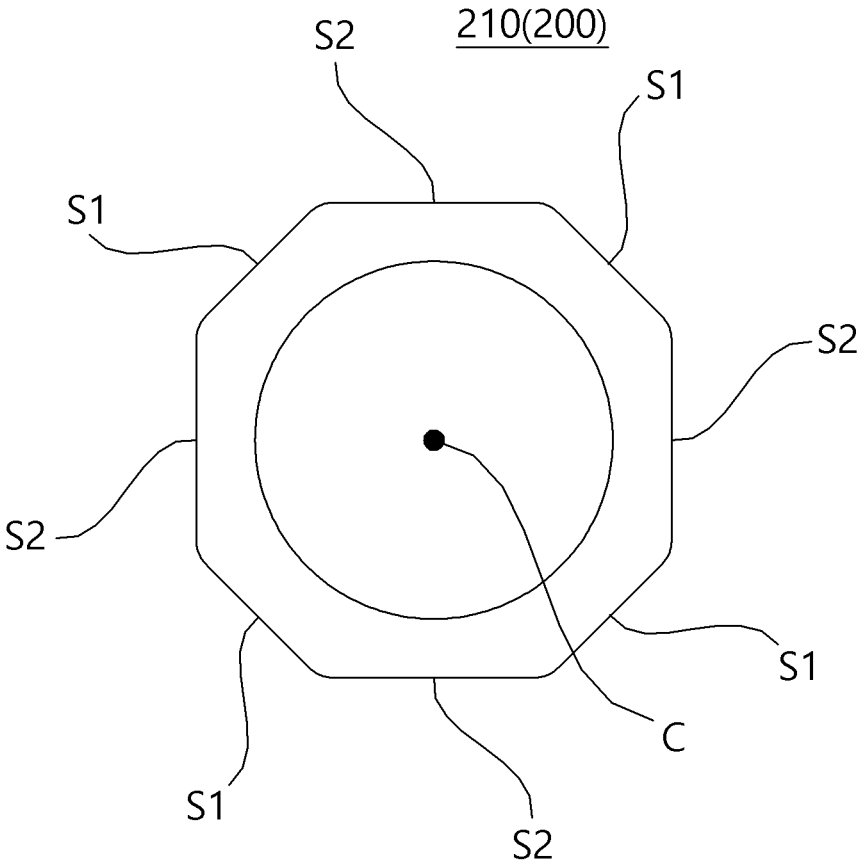
FIG. 6 is a front view of the first magnet shown in FIG. 5.

FIG. 5 is a view of the speaker unit 10 including the first magnet 210, and FIG. 6 is a front view of the first magnet 210 shown in FIG. 5.

Referring to FIGS. 5 and 6, the first magnet 310 may include a first surface 51 and a second surface S2 that are positioned on an outer surface. The first surface 51 is a portion in contact with the inner surface of the frame 100 in the outer surface of the first magnet 210. The second surface S2 is a portion spaced apart from the inner surface of the frame 100 in the outer surface of the first magnet 210. The first surface 51 and the second surface S2 may be alternately arranged along the circumference with respect to the center of the first magnet 210. The first surface 51 and the second surface S2 may be arranged to form a right angle or an obtuse angle to each other. The outer surface of the first magnet 210 may have a polygonal shape. For example, the outer surface of the first magnet 210 may have an octagonal shape.

The second surface S2 defines a space with the inner surface of the frame in the radial direction y to generate the first sound emission path P1.

Figure 7:
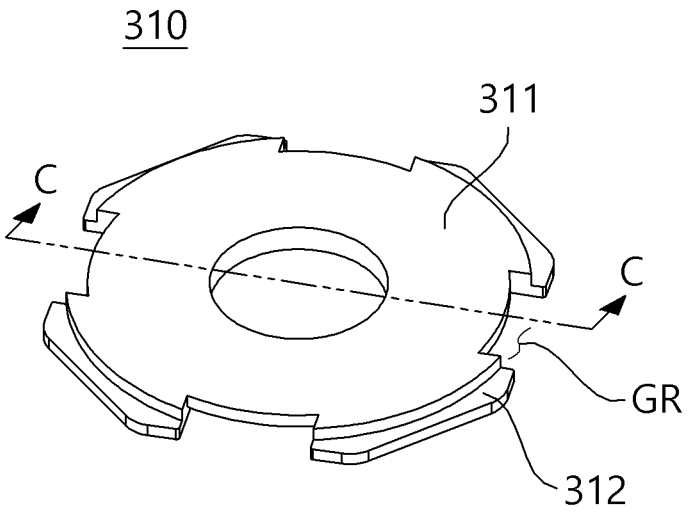
FIG. 7 is a view of a first A plate of a first plate.
Figure 8:
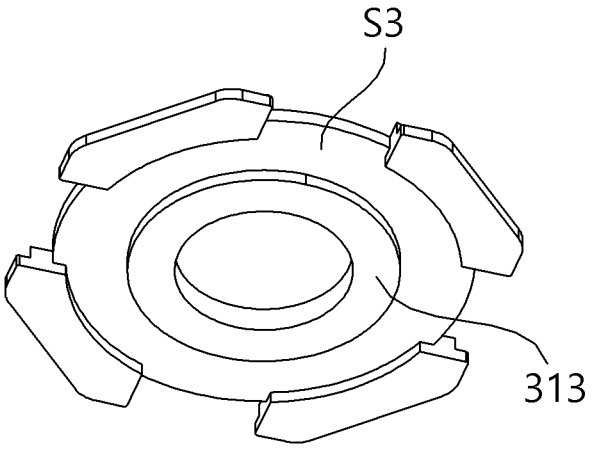
FIG. 8 is a bottom view of the first A plate shown in FIG. 7.
Figure 9:
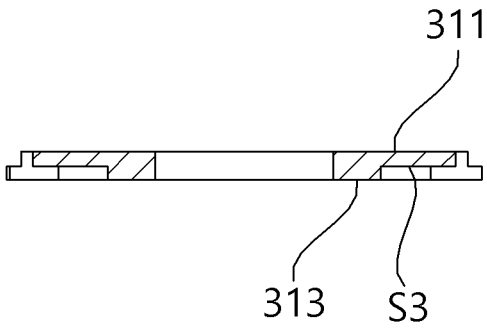
FIG. 9 is a side cross-sectional view of the first A plate taken along line C-C of FIG. 7.

FIG. 7 is a view of the first A plate of the first plate 300, FIG. 8 is a bottom view of the first A plate 310 shown in FIG. 7, and FIG. 9 is a side cross-sectional view of the first A plate taken along line C-C of FIG. 7.

Referring to FIGS. 7 to 9, the first A plate 310 may include at least one groove GR. The groove GR is formed to be recessed inward from an outer surface of the first A plate 310. The groove GR is aligned with the second surface S2 of the magnet 200 and communicates with the first sound emission path P1. The groove GR may be provided in plural. The number of grooves GR may correspond to the number of the second surfaces S2.

Meanwhile, the first A plate 310 may include an inner portion 311 and an outer portion 312. The outer portion 312 is positioned outside the inner portion 311. The outer portion 312 may be disposed to be stepped from the inner portion 311. In addition, the first A plate 310 includes a third surface S3. The third surface S3 is where the second sound emission path P2 and a third sound emission path P3 are formed.

The first A plate 310 may include a contact surface 313 in contact with one surface of the first magnet 210. The contact surface 313 may have an annular shape.

Figure 10:
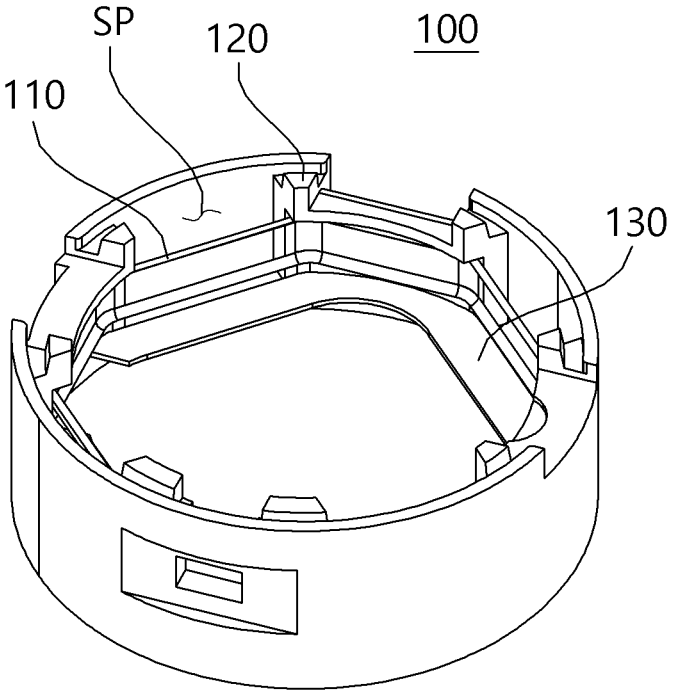
FIG. 10 is a view of a frame.
Figure 11:
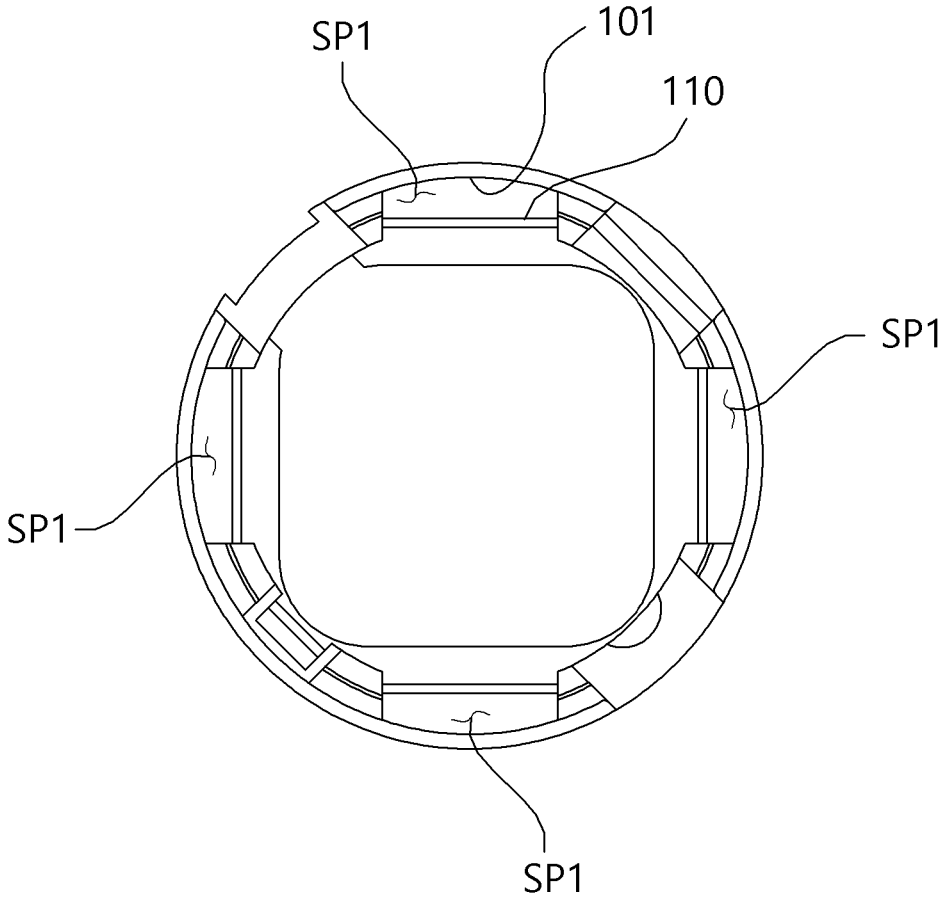
FIG. 11 is a plan view of the frame shown in FIG. 10.

FIG. 10 is a view of the frame 100, and FIG. 11 is a plan view of the frame 100 shown in FIG. 10.

Referring to FIG. 10, the frame 100 may include a guide bar 110 and a protruding portion 120. The protruding portion 120 protrudes inward from the inner surface of the frame 100. A plurality of protruding portions 120 may be arranged at regular intervals along the circumferential direction of the frame 100. The guide bar 110 may be disposed between the protruding portions 120 adjacent in the circumferential direction. A space SP that forms the second sound emission path P2 is provided between the inner surface of the frame 100 and the guide bar 100 in the radial direction y.

The guide bar 110 is in contact with the second surface S2 of the first magnet 210 and supports the first magnet 210. The guide bar 110 may be arranged in double rows.

The frame 100 may include a support 130. The support 130 is disposed extending inward from the protruding portion 120. The support 130 is in contact with a lower surface of the first magnet 210 and supports the first magnet 210.

Figure 12:
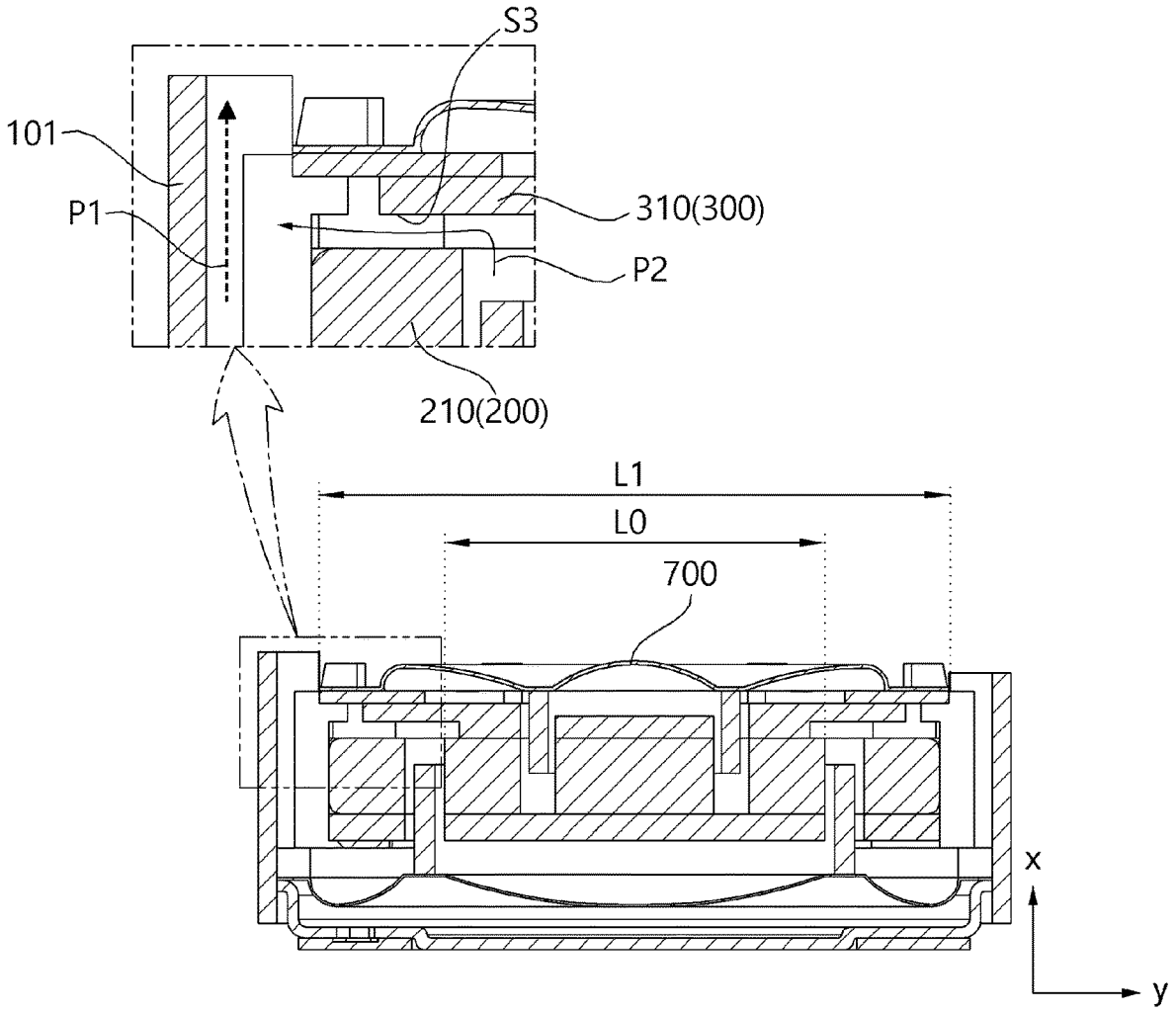
FIG. 12 is a side cross-sectional view of the speaker unit taken along line A-A of FIG. 2.

FIG. 12 is a side cross-sectional view of the speaker unit 10 taken along line A-A of FIG. 2.

Referring to FIGS. 2 and 12, the frame 100 forms the first sound emission path P1 defined by the space between the inner surface 101 of the frame 100 and the second surface S2 of the first magnet 210 in the radial direction y. In addition, one surface of the first magnet 210 and the third surface S3 of the first A plate 310 are spaced apart from each other in the front-to-rear direction x to form the second sound emission path P2. The first A plate 310 is disposed such that the third surface S3 thereof partially overlaps the first magnet 210 in the front-to-rear direction. The second sound emission path P2 communicates with the first sound emission path P1.

A portion of the low-frequency sound produced by the second diaphragm 800 is emitted forward through the first sound emission path P1. Also, another portion of the low-frequency sound produced is emitted forward through the second sound emission path P2. The low-frequency sound is emitted forward through the first sound emission path P1 as well as through the second sound emission path P2, and thus it is advantageous in that loss of low-frequency sound is reduced.

Since a space is secured between the first magnet 210 and the first A plate 310 in the front-to-rear direction x, there is no need to secure the sound emission path by reducing the size of the first diaphragm 700, as depicted by L0 in FIG. 12. Thus, the size of the first diaphragm 700 can be sufficiently enlarged, as depicted by L1 in FIG. 12, thereby increasing the intensity of sound and extending the reproducible sound range.

Figure 13:
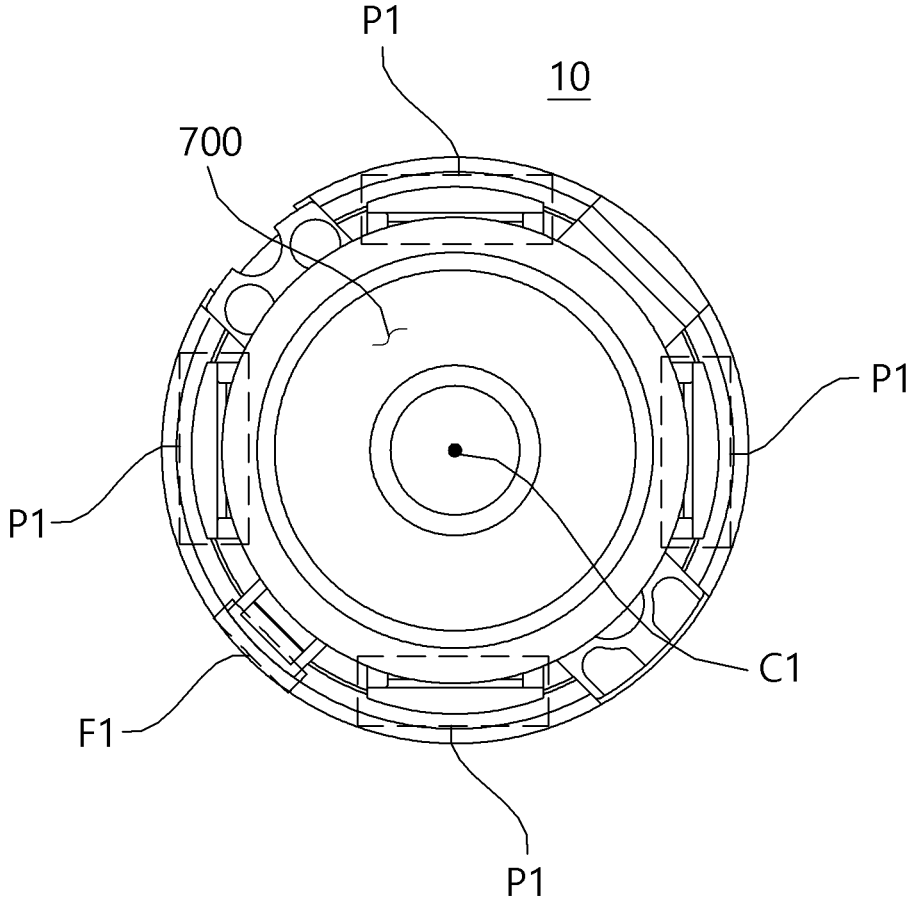
FIG. 13 is a plan view of the speaker unit.

FIG. 13 is a plan view of the speaker unit 10.

Referring to FIG. 13, the speaker unit 10 may include a plurality of first sound emission paths P1. The plurality of first sound emission paths P1 may be disposed at regular intervals along the circumferential direction of the speaker unit 10. The plurality of first sound emission paths P1 may be disposed to be rotationally symmetric with respect to the center Cl of the speaker unit 10.

Figure 14:
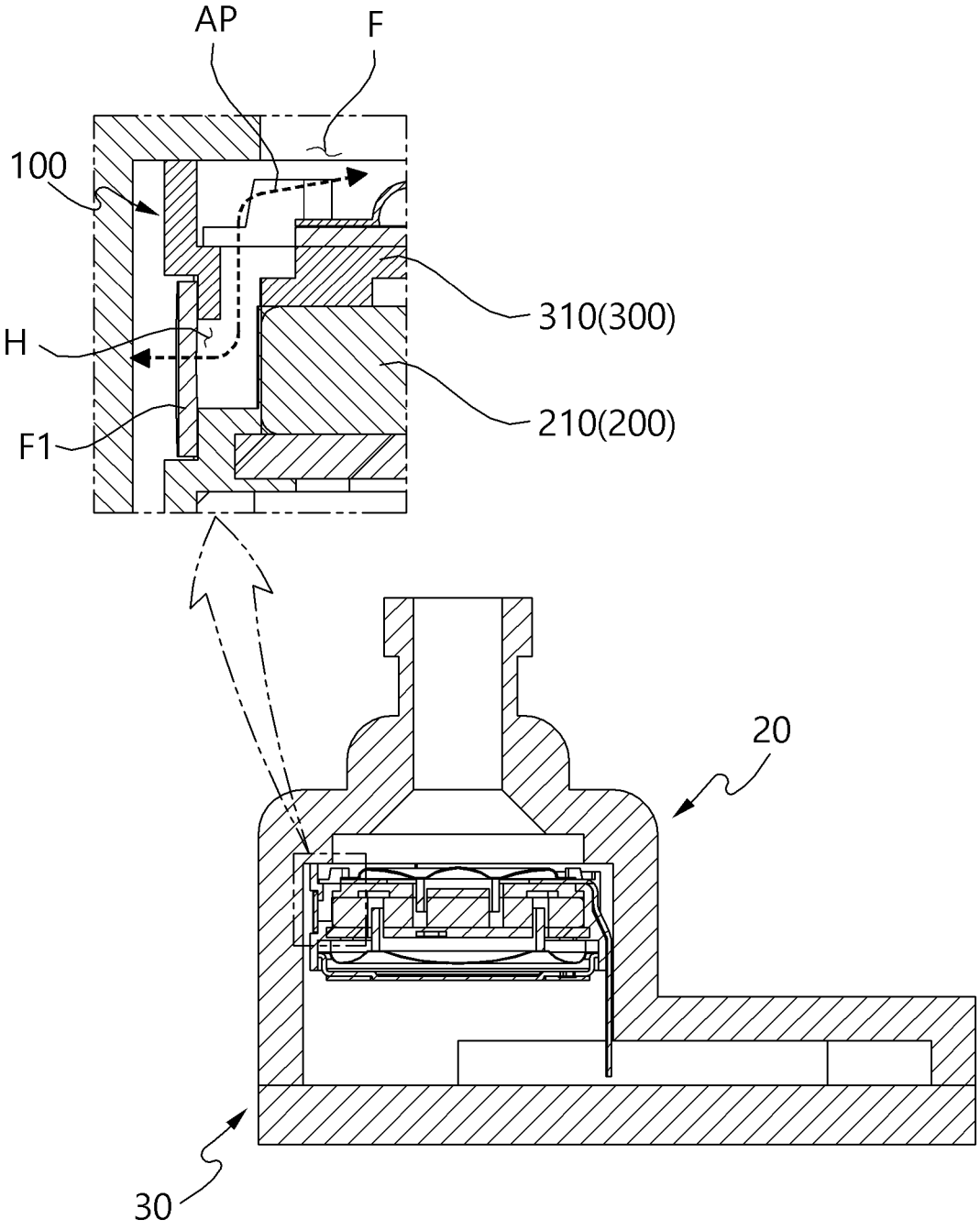
FIG. 14 is a side cross-sectional view of the speaker unit taken along line B-B of FIG. 2, showing an air pressure equalization path.

FIG. 14 is a side cross-sectional view of the speaker unit taken along line B-B of FIG. 2, showing an air pressure equalization path.

Referring to FIG. 14, the speaker unit 10 may include an air pressure equalization path AP defined by a space between the first magnet 210 of the frame 100 and the first A plate 310 in the radial direction y. The air pressure equalization path AP allows the space outside the ouster circumferential surface of the frame 100 to communicate with a front surface F of the first diaphragm 700 through a hole H of the frame 100. This air pressure equalization path AP allows the space between the speaker unit 10 and the housing 20 to communicate with the space between the speaker unit 10 and the cover 30, thereby releasing the pressure of the user's ear.

Figure 15:
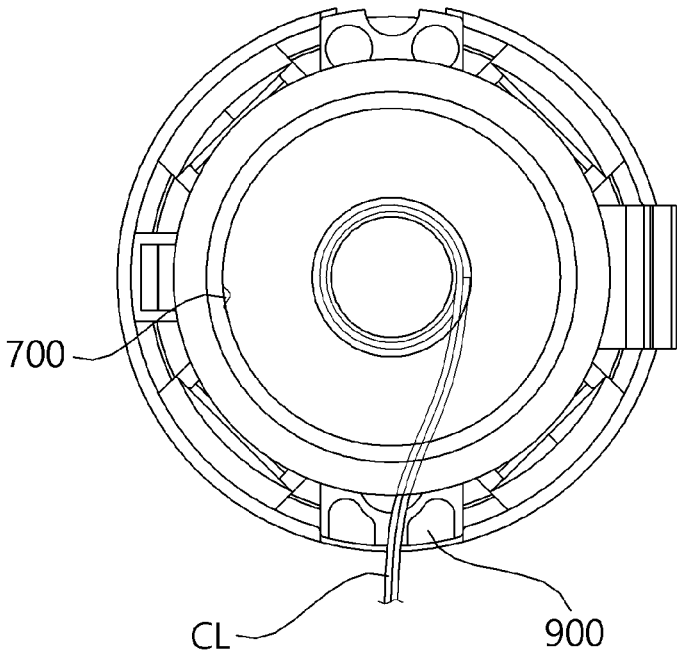
FIG. 15 is a view of a speaker unit from which lead-out portions of a first coil and a second coil are drawn out.
Figure 16:
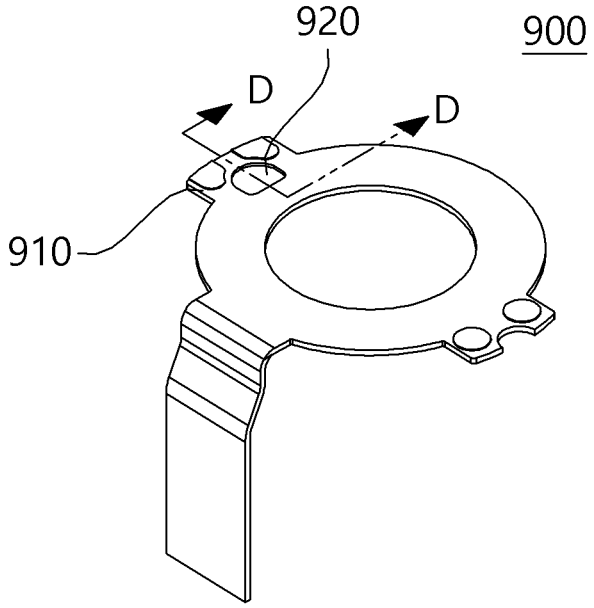
FIG. 16 is a perspective view of a flexible printed circuit board (FPCB) shown in FIG. 3.
Figure 17:
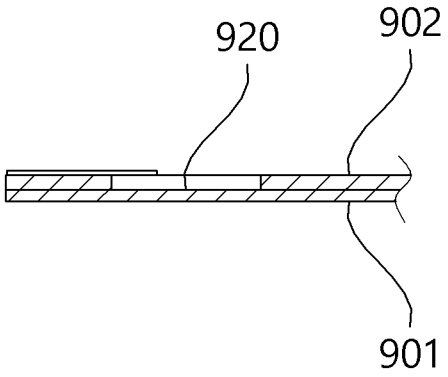
FIG. 17 is a side cross-sectional view of the FPCB taken along line D-D of FIG. 16.
Figure 18:
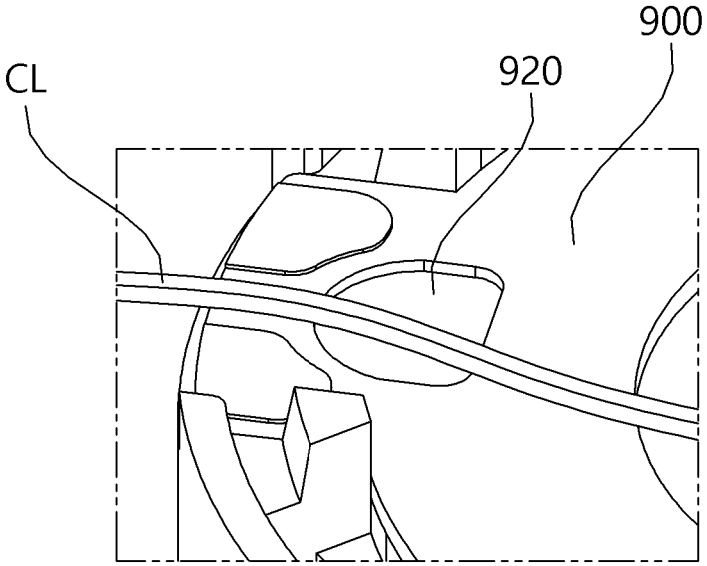
FIG. 18 is a view showing a state in which the lead-out portions escape through an escape portion.

FIG. 15 is a view of the speaker unit 10 from which lead-out portions of the first coil 500 and the second coil 600 are drawn out; FIG. 16 is a perspective view of the FPCB 900 shown in FIG. 3; FIG. 17 is a side cross-sectional view of the FPCB 900 taken along line D-D of FIG. 16; and FIG. 18 is a view showing a state in which the lead-out portions escape through an escape portion.

Referring to FIGS. 3 and 15 to 18, lead-out portions CL of the first coil 500 and the second coil 600 may be drawn out of the speaker unit 10. The lead-out portions CL are located between the first diaphragm 700 and the FPCB 900. Therefore, the first diaphragm 700 is attached to the FPCB 900, there is a risk of disconnection due to interference between the lead-out portions CL and the FPCB 900. To prevent such disconnection, an escape portion 920 may be provided in an extended portion 910 of the FPCB 900.

The FPCB 900 may include the extended portion 910 through which the lead-out portions CL of the first coil 500 and the second coil 600 passes. The extended portion 910 includes the escape portion 920. The escape portion 920 secures a space in which the lead-out portions CL are located, so that the lead-out portions CL and the FPCB 900 are prevented from interfering with each other between the first diaphragm 700 and the FPCB 900. The escape portion 920 may be formed as a groove GR or a hole. In the case of the escape portion 920 formed as the groove GR, a portion of one layer 902 of the FPCB 900 consisting of two stacked layers 901 and 902 may be removed to form the groove GR.

Figure 19:
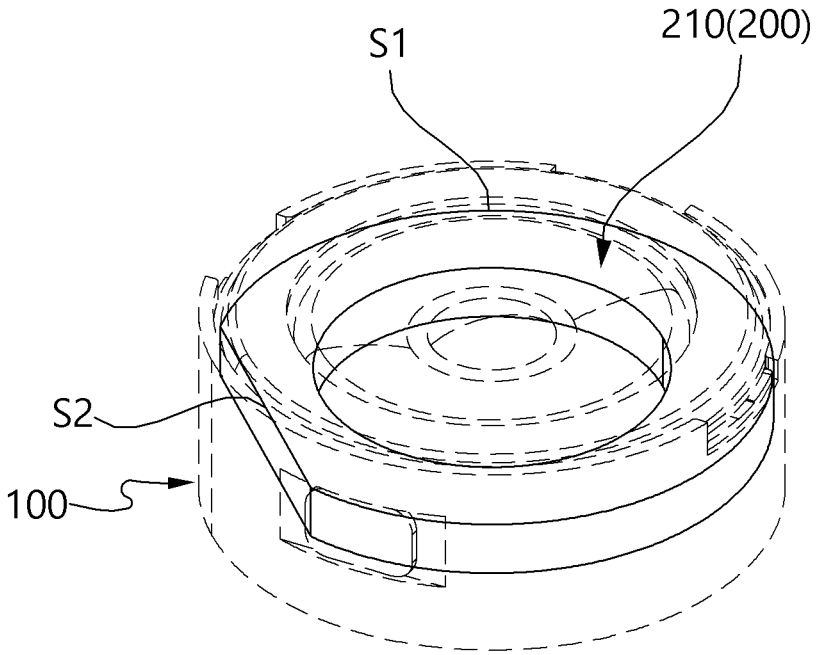
FIG. 19 is a perspective view of a speaker unit including a first magnet according to a modification example.
Figure 20:
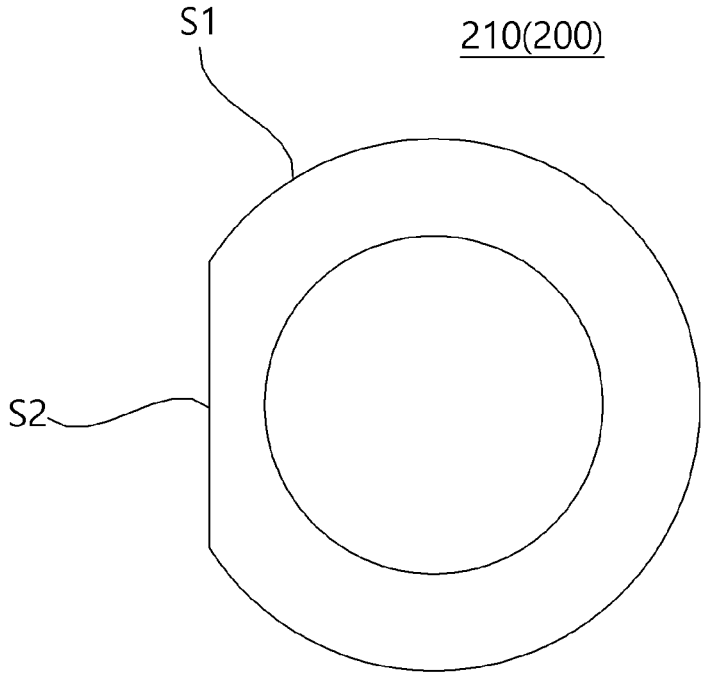
FIG. 20 is a plan view of the first magnet shown in FIG. 19.

FIG. 19 is a perspective view of a speaker unit 10 including a first magnet 210 according to a modification example, and FIG. 20 is a plan view of the first magnet 210 shown in FIG. 19.

Referring to FIGS. 19 and 20, in the first magnet 210 according to the modification example, a first surface 51 may be a curved surface and a second surface S2 may be a flat surface. For example, a portion of the outer surface of the first magnet 210 may be the first surface 51 formed as a curved surface, and the rest of the outer surface of the first magnet 210 may be the second surface S2 formed as a flat surface. The first magnet 210 may have a shape in which a portion of a ring-shaped magnet 200 is cut off. Although not shown in the drawing, the first surface 51 may be a flat surface, and the second surface S2 may be a curved surface. Alternatively, both the first and second surfaces 51 and S2 may be flat surfaces. Alternatively, both the first and second surfaces 51 and S2 may be curved surfaces.

Figure 21:
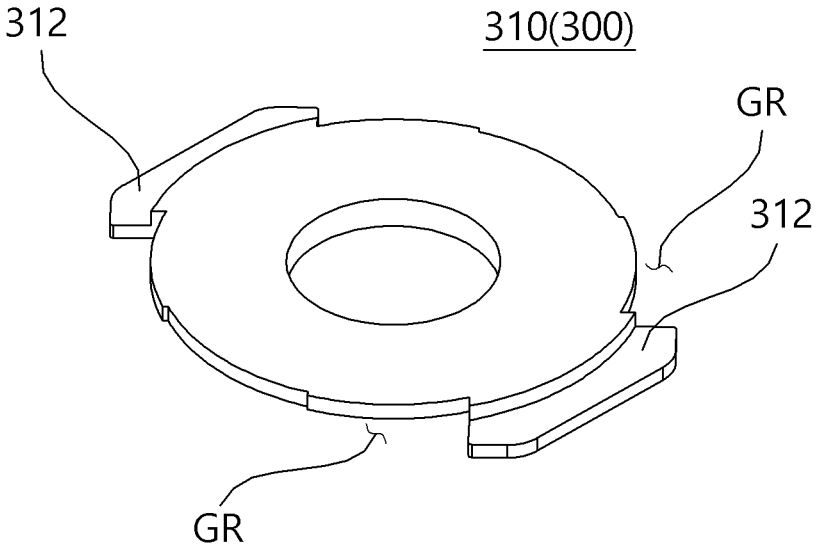
FIG. 21 is a view of a first plate according to a modification example.
Figure 22:
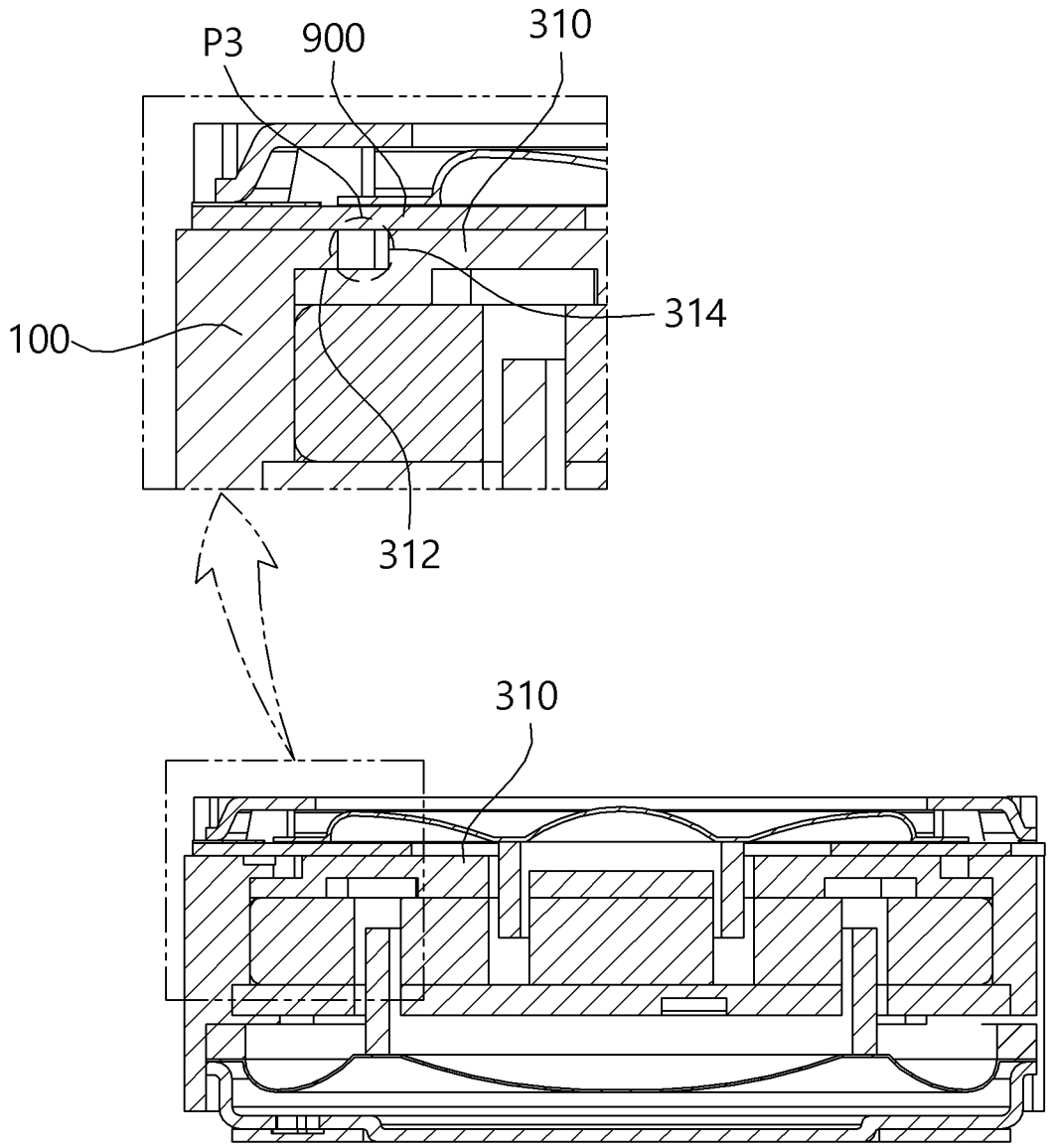
FIG. 22 is a side cross-sectional view of a speaker unit showing a third sound emission path.

FIG. 21 is a view of a first plate 300 according a modification example, and FIG. 22 is a side cross-sectional view of a speaker unit 10, showing a third sound emission path P3.

Referring to FIGS. 21 and 22, the first plate 300 according to the modification example includes two outer portions 312, and a groove GR is formed between the two outer portions 312 along the circumferential direction of the first plate 300. The groove GR corresponds to the first sound emission path P1.

The speaker unit 10 may include a third sound emission path P3. The third sound emission path P3 is defined by a space between a stepped surface 314 between an inner portion 311 and the outer portions 312, the FPCB 900, and the frame 100. The third sound emission path P3 communicates with the first sound emission path P1 and the second sound emission path P2. The third sound emission path P3 expands an emission path of low-frequency sound in a region that corresponds to the first surface 51 of the first magnet 210 in the radial direction of the speaker unit 10, thereby reducing loss of low-frequency sound.

Figure 23:
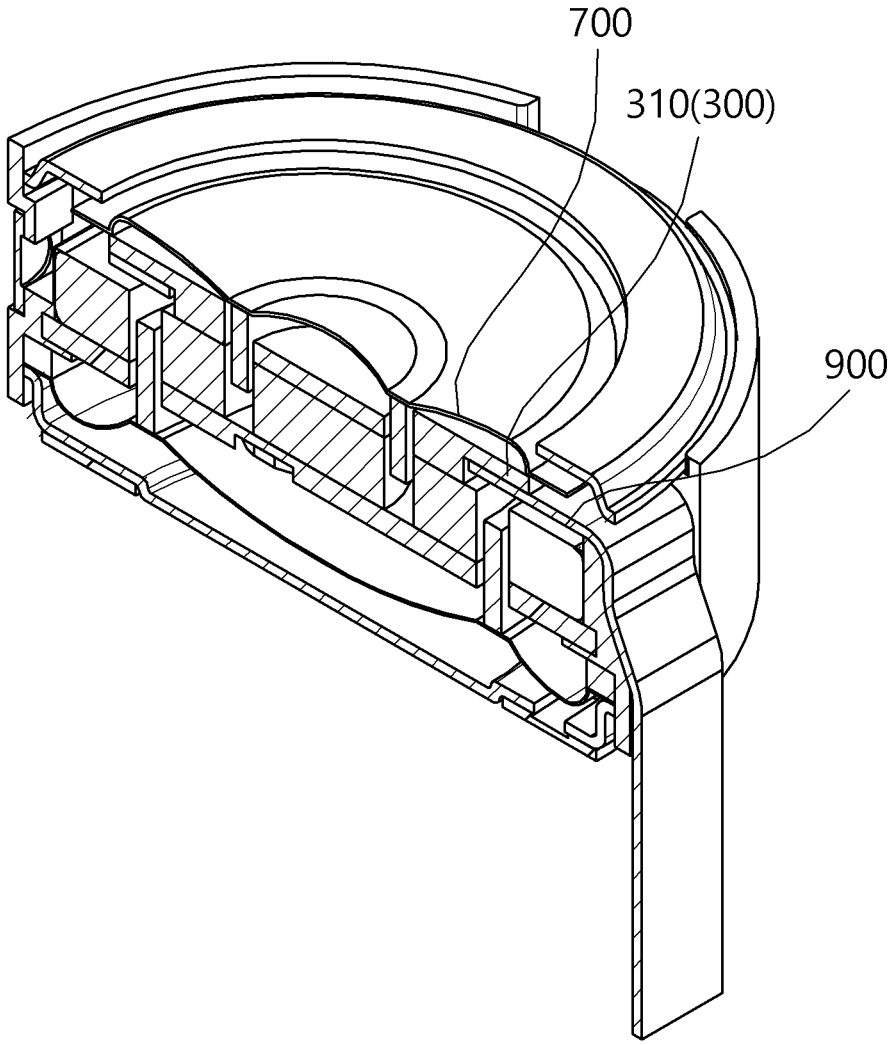
FIG. 23 is a view of a speaker unit including a FPCB and a first A plate according to a modification example.
Figure 24:
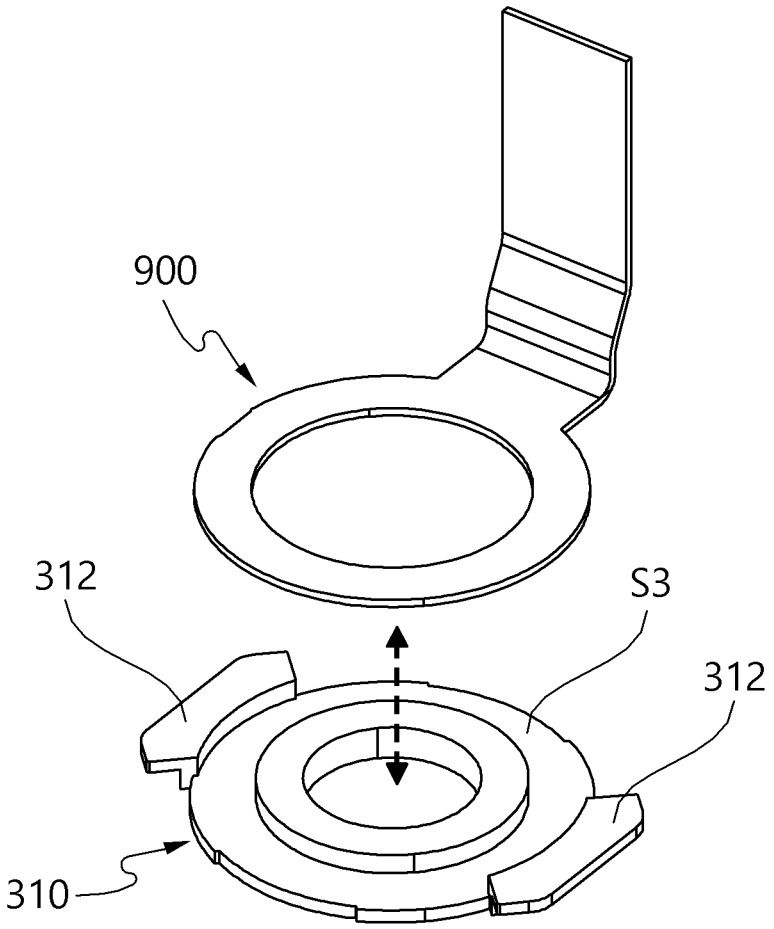
FIG. 24 is a view of the FPCB to be mounted on a third surface of the first A plate.

FIG. 23 is a view of a speaker unit including a FPCB 900 and a first A plate 310 according to a modification example; FIG. 24 is a view of the FPCB 900 to be mounted on a third surface S3 of the first A plate 310; and FIG. 25 is a view showing a state in which the FPCB 900 is mounted on the third surface S3.

Figure 25:
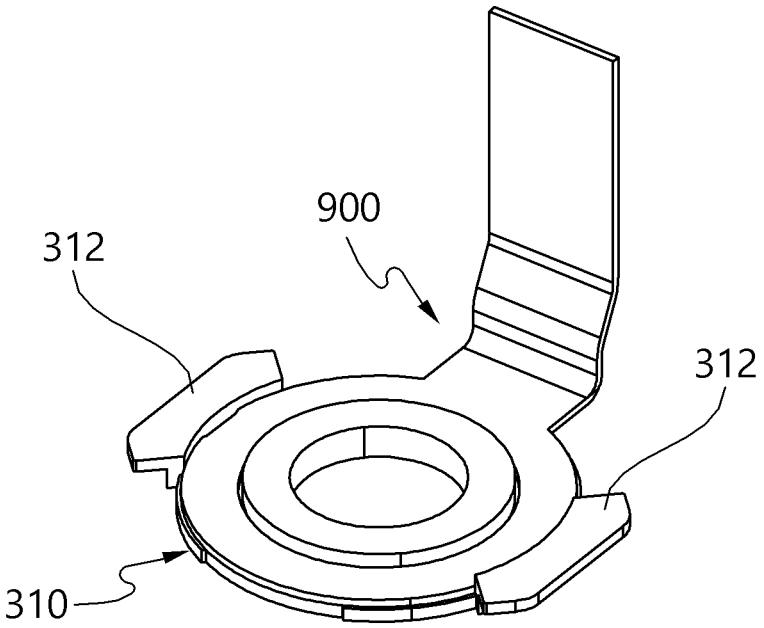
FIG. 25 is a view showing a state in which the FPCB is mounted on the third surface.

Referring to FIGS. 23 to 25, according to the modification example, the FPCB 900 may be attached to the third surface S3 of the first A plate 310. That is, the FPCB 900 may be attached to the third surface S3 that forms the second sound emission path P2, rather than to an upper surface of the first plate 310 facing the first diaphragm 700.

According to the embodiment, the first sound emission path defined by a space between the frame and the magnet is created by changing the shape of the magnet, so that loss of sound volume can be reduced.

According to the embodiment, the second sound emission path defined by a space between the magnet and the plate is created in the front-to-rear direction to secure the expansible space of a high-frequency diaphragm in the radial direction, so that the intensity of sound can be increased and the reproducible sound range can be extended.

According to the embodiment, a path for air pressure equalization is formed between the magnet and the frame, so that the pressure of the user's ear can be released.

Although the preferred embodiments of the speaker unit have been disclosed for illustrative purposes, those skilled in the art will appreciate that various modifications, additions and substitutions are possible, without departing from the scope and spirit of the invention as disclosed in the accompanying claims. Therefore, it should be noted that such modifications or changes belong to the claims of the present invention.

What is claimed is:

1. A speaker unit for an earphone, comprising:

a frame;

a magnet;

a plate fixed to the frame and in contact with the magnet;

a diaphragm;

a coil disposed to overlap the magnet and the plate in a radial direction; and a flexible printed circuit board (FPCB), wherein the magnet includes a plurality of first surfaces and a plurality of second surfaces arranged on an outer surface of the magnet, the plurality of first surfaces are in contact with an inner surface of the frame, the plurality of second surfaces are spaced apart from the inner surface of the frame, and the frame forms a plurality of first sound emission paths, each of which is defined by a space between the inner surface thereof and one of the plurality of second surfaces of the magnet in the radial direction, wherein the plurality of first surfaces and the plurality of second surfaces are alternately disposed along the outer surface of the magnet, wherein the plurality of second surfaces are flat surfaces, wherein the plate comprises a first plate in contact with one side of the magnet and a second plate in contact with the other side of the magnet, the diaphragm comprises a first diaphragm disposed in front of the first plate and a second diaphragm disposed at a rear of the second plate, and the first plate comprises a third surface spaced apart from the magnet in a front-to-rear direction, the first plate and the magnet form a second sound emission path connected to the plurality of first sound emission paths, and the second sound emission path is defined by a space between the third surface and the magnet, wherein the first plate comprises an inner portion and an outer portion which is disposed outside the inner portion and disposed to be stepped from the inner portion, and a third sound emission path defined by a space between a stepped surface between the inner portion and the outer portion, the FPCB, and the frame is formed, and wherein the third sound emission path communicates with the first sound emission paths and the second sound emission path.

2. The speaker unit of claim 1, wherein the frame comprises a plurality of grooves corresponding to the plurality of second surfaces and separating the plurality of second surfaces and the inner surface of the frame, and a guide portion in contact with the plurality of second surfaces.

3. The speaker unit of claim 1, wherein the plurality of first surfaces are flat surfaces, and the plurality of first surfaces and the plurality of second surfaces are disposed to form a right angle or an obtuse angle to each other.

4. The speaker unit of claim 1, wherein the plurality of first surfaces are curved surfaces.

5. The speaker unit of claim 1, further comprising a first coil fixed to the first diaphragm and a second coil fixed to the second diaphragm, wherein the FPCB comprises an extended portion through which a connection end of the first coil and the second coil passes and the extended portion comprises an escape portion spaced apart from the first coil.

6. The speaker unit of claim 1, wherein the frame further comprises a hole penetrating inside and outside of the frame, the speaker unit further comprises an air pressure equalization path defined by a space between the frame, the magnet, and the first plate, and the air pressure equalization path allows the outside of the frame and a front space of the first diaphragm to communicate with each other through the hole.

7. The speaker unit of claim 1, wherein the FPCB is attached to the third surface of the first plate.

* * * * *